US011608634B2

(12) United States Patent
Kuchman et al.

(10) Patent No.: US 11,608,634 B2
(45) Date of Patent: Mar. 21, 2023

(54) FLEXIBLE WORKSPACE PARTITION SYSTEM

(71) Applicant: Watson Furniture Group, Inc., Poulsbo, WA (US)

(72) Inventors: Christopher Kuchman, Poulsbo, WA (US); Ethan Pearl, Poulsbo, WA (US); Lucas Pearl, Poulsbo, WA (US)

(73) Assignee: Watson Furniture Group, Inc., Poulsbo, WA (US)

( * ) Notice: Subject to any disclaimer, the term of this patent is extended or adjusted under 35 U.S.C. 154(b) by 407 days.

(21) Appl. No.: 16/863,260

(22) Filed: Apr. 30, 2020

(65) Prior Publication Data

US 2020/0347592 A1 Nov. 5, 2020

Related U.S. Application Data

(60) Provisional application No. 62/843,255, filed on May 3, 2019.

(51) Int. Cl.
*E04B 2/74* (2006.01)

(52) U.S. Cl.
CPC ..... *E04B 2/7431* (2013.01); *E04B 2/7442* (2013.01); *E04B 2002/7446* (2013.01);
(Continued)

(58) Field of Classification Search
CPC ..... E04B 2/7431; E04B 2/7442; E04B 2002/7446; E04B 2002/7483;
(Continued)

(56) References Cited

U.S. PATENT DOCUMENTS 5,013,112 A 5/1991 Hellwig
5,065,559 A * 11/1991 Zegel ..... E04B 2/7427 52/239

(Continued)

FOREIGN PATENT DOCUMENTS

CA 2360142 A1 * 4/2003 ..... E04B 2/7425
CA 2407218 A1 * 4/2003 ..... E04B 2/7424

(Continued)

*Primary Examiner* — Babajide A Demuren
(74) *Attorney, Agent, or Firm* — Christensen O'Connor Johnson Kindness PLLC

(57) ABSTRACT

A partition assembly includes partitions hingedly connected in series. The partitions include a frame with a spaced upright member, a mounting assembly, and upper and lower cross members connecting the upright members. One or both cross members include power and/or data ports. Panels disposed on either side of the frame are movable between upper and lower positions, providing access to the ports. Upper and lower hinge assemblies connect the partitions. The hinge assemblies include gear arms fixed to the upright members with gear heads extending away from the partition that engage the gear head of an adjacent partition. The upright members include aligned apertures defining ports providing a cable passageway from the interior of adjacent partitions. End foot assemblies extend from the ends of the partition assembly and interior foot assemblies extends from between the geared connections of the partitions.

19 Claims, 10 Drawing Sheets

(52) U.S. Cl.
CPC ..... *E04B 2002/7483* (2013.01); *E04B 2002/7488* (2013.01)

(58) Field of Classification Search
CPC ..... E04B 2002/7488; E04B 2002/7418; E04B 2/7433
See application file for complete search history.

(56) References Cited

U.S. PATENT DOCUMENTS

| | | | | | |
|---|---|---|---|---|---|
| 5,685,113 | A | | 11/1997 | Reuter et al. | |
| 5,831,211 | A | | 11/1998 | Gartung et al. | |
| 5,966,777 | A | * | 10/1999 | Jantschek | E04B 2/7431 16/354 |
| 6,098,358 | A | * | 8/2000 | Waalkes | E04B 2/7433 52/36.6 |
| 6,223,478 | B1 | | 5/2001 | Wheeler | |
| 6,397,532 | B1 | * | 6/2002 | Shipman | A47B 96/04 52/239 |
| 2002/0029529 | A1 | * | 3/2002 | Waalkes | E04B 2/7433 52/36.5 |
| 2002/0138947 | A1 | * | 10/2002 | Jantschek | E04B 2/7431 16/371 |
| 2003/0155083 | A1 | * | 8/2003 | MacDonald | E04B 2/7425 160/135 |
| 2004/0020137 | A1 | * | 2/2004 | Battey | E04B 2/7425 52/220.7 |
| 2008/0104926 | A1 | * | 5/2008 | Lamfers | E04B 2/7425 52/787.1 |
| 2008/0302553 | A1 | | 12/2008 | Ross et al. | |
| 2017/0037616 | A1 | * | 2/2017 | Fleischman | E04B 2/7433 |
| 2018/0073249 | A1 | * | 3/2018 | Feldpausch | E04C 2/52 |

FOREIGN PATENT DOCUMENTS

| | | | | | |
|---|---|---|---|---|---|
| CA | 2428593 | A1 | * | 11/2003 | E04B 2/7425 |
| CA | 2668445 | A1 | * | 12/2010 | E04B 2/7425 |
| CA | 2742576 | A1 | * | 12/2012 | E04B 2/7425 |
| DE | 4411278 | A1 | * | 10/1995 | E04B 2/7431 |
| DE | 202004002002 | U1 | * | 7/2004 | E04B 2/7431 |
| DE | 202007000281 | U1 | * | 4/2007 | E04B 2/7431 |
| EP | 145409 | A | * | 6/1985 | A47B 83/001 |
| FR | 2607558 | A1 | * | 6/1988 | |
| GB | 2147196 | A | * | 5/1985 | E04B 2/7431 |
| GB | 2260213 | A | * | 4/1993 | E04B 2/7431 |
| KR | 2017135487 | A | * | 12/2017 | E04B 1/40 |
| NL | 8602258 | A | * | 4/1988 | E04B 2/7431 |
| WO | 99/63177 | A1 | | 12/1999 | |

* cited by examiner

FLEXIBLE WORKSPACE PARTITION SYSTEM

CROSS-REFERENCE TO RELATED APPLICATION

This application claims the benefit of Provisional Application No. 62/843,255, filed May 3, 2019. The entire disclosure of said application is hereby incorporated by reference herein.

BACKGROUND

A continuing challenge in modern office environments is the need to accommodate and adapt to changing work styles and new technology. Office furniture's large cost and coordination to replace results in it needing to support a business far into the future. The desire for futureproofing makes flexibility and modifiability in the arrangement of workstation furniture and related equipment, for example, desks, panel dividers, bookshelves, tables, movable walls, and other equipment to accommodate changing needs of users highly desirable. Often workspaces also contain particular physical features, for example existing structural columns, electrical access placement, or other existing physical infrastructure in a user space that inhibit consistent layouts. A large challenge in reconfigurable office workspace systems is the need to provide convenient and reliable power and data port access to users in a flexible manner, without interfering with the functionality or aesthetics of the work environment. Data cables and power conduit pose a considerable challenge to flexibility as they require a minimum bend radius to not experience damage or loss of functionality. Damage to data cabling can halt productivity and cause the loss of work product. Damage to power conduit can result in loss of power, which can also halt productivity and loss of work product, but can also produce hazardous conditions, including risk of electrical shock and/or fire.

U.S. Pat. No. 5,013,112, to Hellweg, which is hereby incorporated by reference in its entirety, discloses an office paneling system with fiber optic communication cabling. Hellwig recognizes that a disadvantage of fiber optic cables is that the quality of signals passing through the cables generally decreases with bending (end bend radius) in the cables. The frame members of the paneling system include passage ports in the vertical members to accommodate cables, allowing cable passage through panels disposed at 90 degrees to each other without requiring a small bending radius in the cables. However, the system does not provide flexibility in the configuration of the system, with fixed-width paneling shown between adjacent panels.

U.S. Pat. No. 7,055,287, to Yu et al., which is hereby incorporated by reference in its entirety, discloses a space-dividing wall panel system having a plurality of serially connected base panels, wherein a central spine wall provides the primary load-bearing and cable-carrying capacity of the wall panel system. The spine wall includes a raceway to accommodate cables. The flexibility in the system is provided by the return walls that connect to the spine wall.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A partition assembly includes a plurality of partitions including a first partition hingedly connected to a second partition. The first and second partitions have a frame with first and second upright members, connected by upper and lower cross members. Optionally, a mounting assembly connects the first and second upright members above the first cross member. A first panel is attached to one side of the frame, and a second panel attached to an opposite side of the frame. At least one of the first and second panels are movable between an upper position and a lower position to provide access to the frame and the a volume defined between the first and second panels. An upper hinge assembly extends between and connects the first and second partitions. The upper hinge assembly includes a first gear arm fixed to the first partition and having a gear head, a second gear arm fixed to the second partition and having a gear head. The first and second gear heads engage with a connection assembly pivotably holding the first gear head and the second gear head in the engaged position. Similarly, a lower hinge assembly extends between and connects the first partition to the second partition. The lower hinge assembly includes a third gear arm having a gear head and a fourth gear arm having a gear head. The third and fourth gear heads engage with a connection assembly pivotably holding the third gear head and the fourth gear head in the engaged position. The first upright member of the first partition includes a first aperture and the second upright member of the second partition includes a second aperture that is aligned with the first aperture. The first and second apertures providing a cable passageway from an interior of the first partition to an interior of the second partition between the upper hinge assembly and the lower hinge assembly.

In an embodiment at least one end leg assembly extends downwardly from the first end of the partition assembly and at least one interior leg assembly extends downwardly from a position between the first and second partitions. In some embodiments the end leg assemblies and the interior leg assemblies are height adjustable. In some embodiments the leg assemblies include a post portion and an elongate foot portion.

In an embodiment at least one power port and/or one data port is fixed to the upper cross member. In an embodiment the lower cross member has a U-shaped cross section and a plurality of cable keepers.

In an embodiment the partition assembly includes a power cable that extends through a cable passageway from the interior of the first partition into the interior of the second partition.

In an embodiment the mounting assembly is configured to releasably attach accessories to the partition assembly, for example a privacy screen, a table, a lighting element, and the like.

In an embodiment the mounting assembly includes a pair of spaced-apart elongate frame members that extend along a length of the mounting assembly. In an embodiment the mounting assembly includes an upper mounting plate having at least one slot aligned with the elongate frame members.

A partition assembly includes a first partition hingedly connected to a second partition. The first and second partition each include a frame with a first upright member, a second upright member, an upper cross member and a lower cross member. First and second panels are attached to opposite sides of the frame. At least one of the first and second panels is configured to be movable between an upper position and a lower position providing access to the first and second crossmembers. An upper hinge assembly connects the first partition to the second partition. The upper hinge assembly includes a first gear arm fixed to the first partition, a second gear arm fixed to the second partition. The first and second gear arms engage, with a connection assembly that pivotably holds the first gear head and the second gear head in the engaged position. A lower hinge assembly extends between and connects the first partition to the second partition. The lower hinge assembly includes a third gear arm fixed to the first partition and a fourth gear arm fixed to the second partition. Corresponding gear heads engage and a connection assembly pivotably holding the third gear head and the fourth gear head in the engaged position. The first upright member of the first partition includes a first aperture and the second upright member of the second partition includes a second aperture that is aligned with the first aperture, the first and second apertures providing a cable passageway from an interior of the first partition to an interior of the second partition between the upper hinge assembly and the lower hinge assembly.

In an embodiment an end leg assembly extends downwardly from an end of the partition assembly and an interior leg assembly extends downwardly from a position between the first and second partitions.

In an embodiment the leg assemblies are height adjustable. In an embodiment the leg assemblies include a post and an elongate foot portion.

In an embodiment a power port and/or a data port is fixed to the upper cross member. In an embodiment the lower cross member has a U-shaped cross section and a plurality of cable keepers. In an embodiment a power cable that extends through the cable passageway from the interior of the first partition into the interior of the second partition.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A reconfigurable partitioning system including a plurality of flexibly connected partitions is disclosed. The reconfigurable partitioning system is suitable for multi-person workspaces and may be oriented in a continuous variety of adjustable configurations. The partitions include a pair of opposed panels mounted to a frame, with adjacent partitions joined with upper and lower hinge assemblies. The hinge assemblies include engaged gear portions that extend between the adjacent partitions and define two hinge axes equally distanced above the foot assemblies. Internal power and/or data ports are located inside at least some of the partitions and are interconnected with one or more cables that extend between the partitions through ports or apertures in the partitions. The upper and lower hinge assemblies define spaced-apart hinge axes that reduce stresses on cabling extending between partitions. In the current embodiment the partitions include an upper accessory mounting assembly configured to support a wide variety of accessories. This flexibility allows planners to design workspace layouts, for example office layouts, that are tailored to specific needs and preferences of individuals or teams, and/or to accommodate physical features and constraints of the workspace itself. Internal power and/or data ports are accessible to users near the partitions and may be hidden when not in use.

Figure 1A:
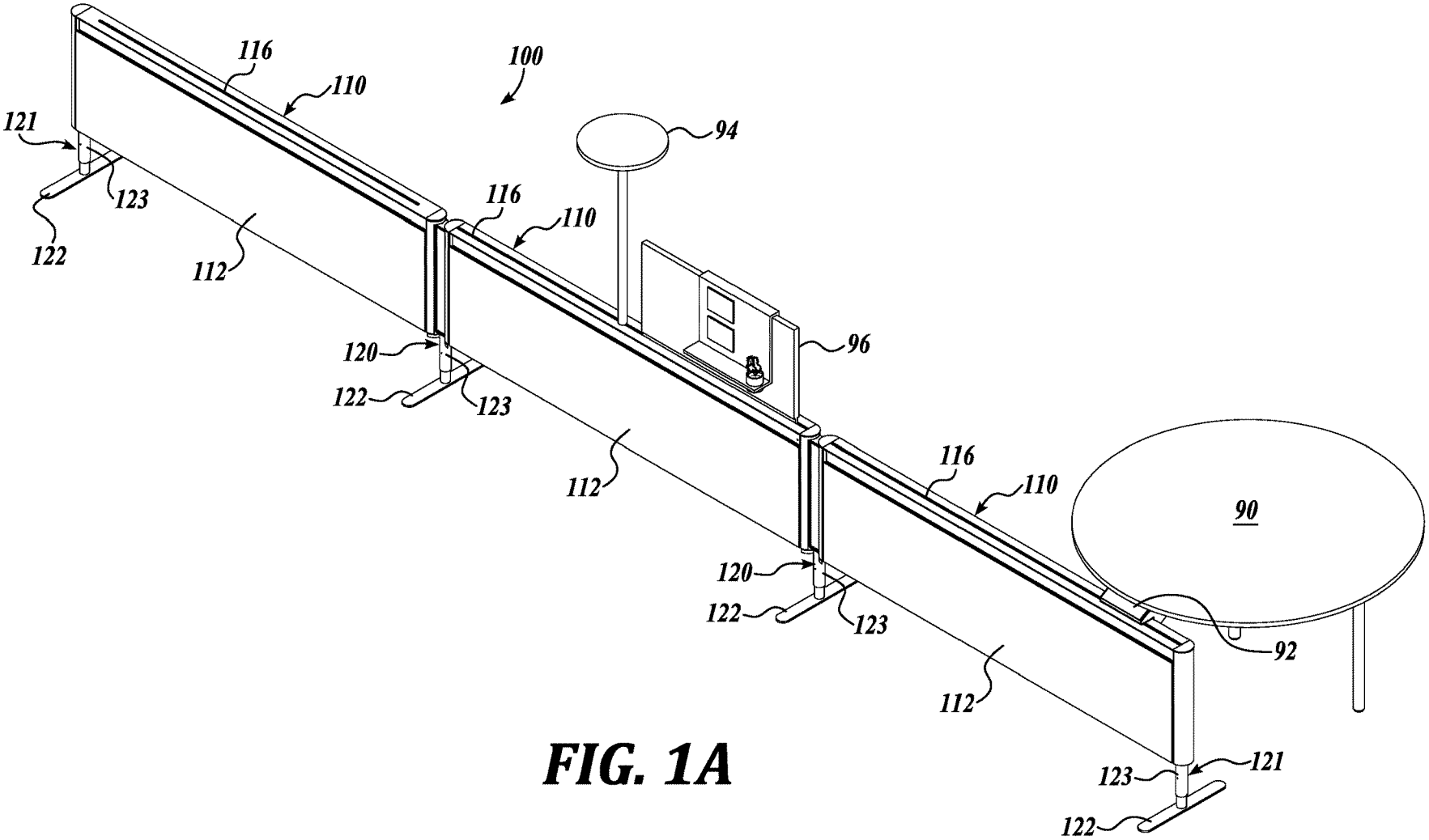
FIG. 1A illustrates an example of a workspace partition system in accordance with the present invention, and having three hingedly connected partitions, and an accessory component engaging, and at least partially supported by, the partitions (in this example the accessory is a table)
Figure 1B:
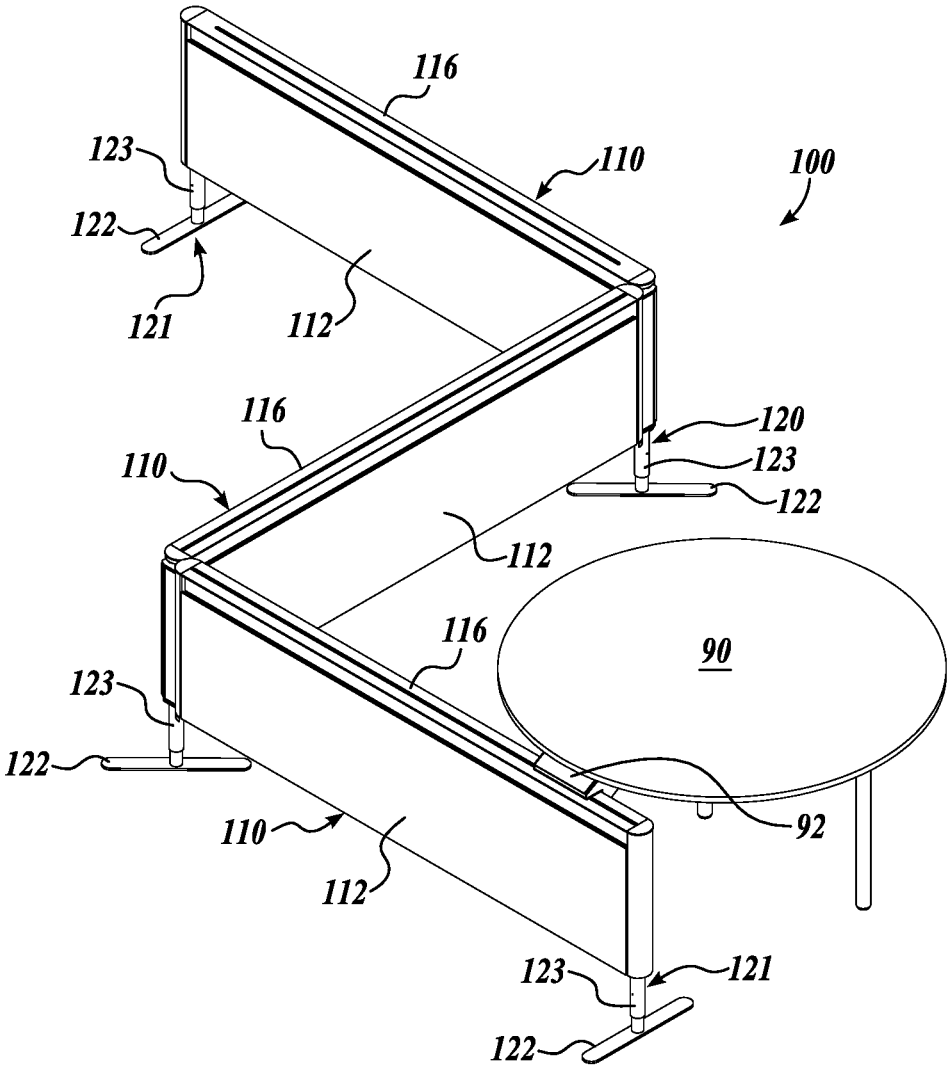
FIG. 1B shows the workspace partition system of FIG. 1A reconfigured with the partitions arranged in a non-linear configuration.

FIGS. 1A and 1B show a partition system 100 in accordance with the present invention. The partition system 100 in this embodiment includes three connected partition assemblies (partitions) 110. FIG. 1A illustrates the partition system 100 with the three partitions 110 in an aligned configuration. FIG. 1B shows the same partition system 100 with the partitions 110 repositioned into a "Z" configuration. The system 100 may be repositioned in continuously variable configurations. Although three partitions 110 are shown, it will be appreciated that partition systems in accordance with the present invention may include any number of partitions 110.

The partitions 110 are supported by a plurality of leg assemblies 120, 121. Interior leg assemblies 120 are configured to support the corresponding ends of two spaced-apart adjacent partitions 110. End leg assemblies 121 support corresponding free ends of the assembled partition system 100. The interior leg assemblies 120 and the end leg assemblies 121 may be similar in appearance. The end leg assemblies 121 are disposed below an end of one of the partitions 110 and the interior leg assembles 120 are located generally between adjacent partitions 110. The leg assemblies 120, 121 in a current embodiment comprise a post portion 123, that may be a telescoping (or otherwise height-adjustable) assembly, and a foot portion 122 connected to a bottom end of the post portion 123. In this embodiment the foot portion 122 is an elongate foot that is pivotable about an axis defined by the post portion 123. The elongate foot portion 122 may therefore be oriented to provide optimal lateral support for the partition system 100 in multiple configurations, for example, bisecting the angle between the associated partitions 110.

The partitions 110 include an upper accessory mounting subassembly 116 that is configured to selectively engage and/or support accessory components, and a pair of panels 112 disposed on opposite sides of the partition 110 below the mounting subassembly 116. Partition accessories, for example, table 90, lighting 94, and a privacy panel/shelf 96, are shown connected to the partitions 110. The accessories 90 include a connector portion (e.g., connector 92) that are removably attached to the mounting subassembly 116. Other accessories are contemplated that may be used individually or in combination. For example, mountable accessories may include shelves, whiteboards, other display or posting boards, light fixtures, planters, sound-dampening panels, electronic displays, storage bins, and the like.

Figure 2A:
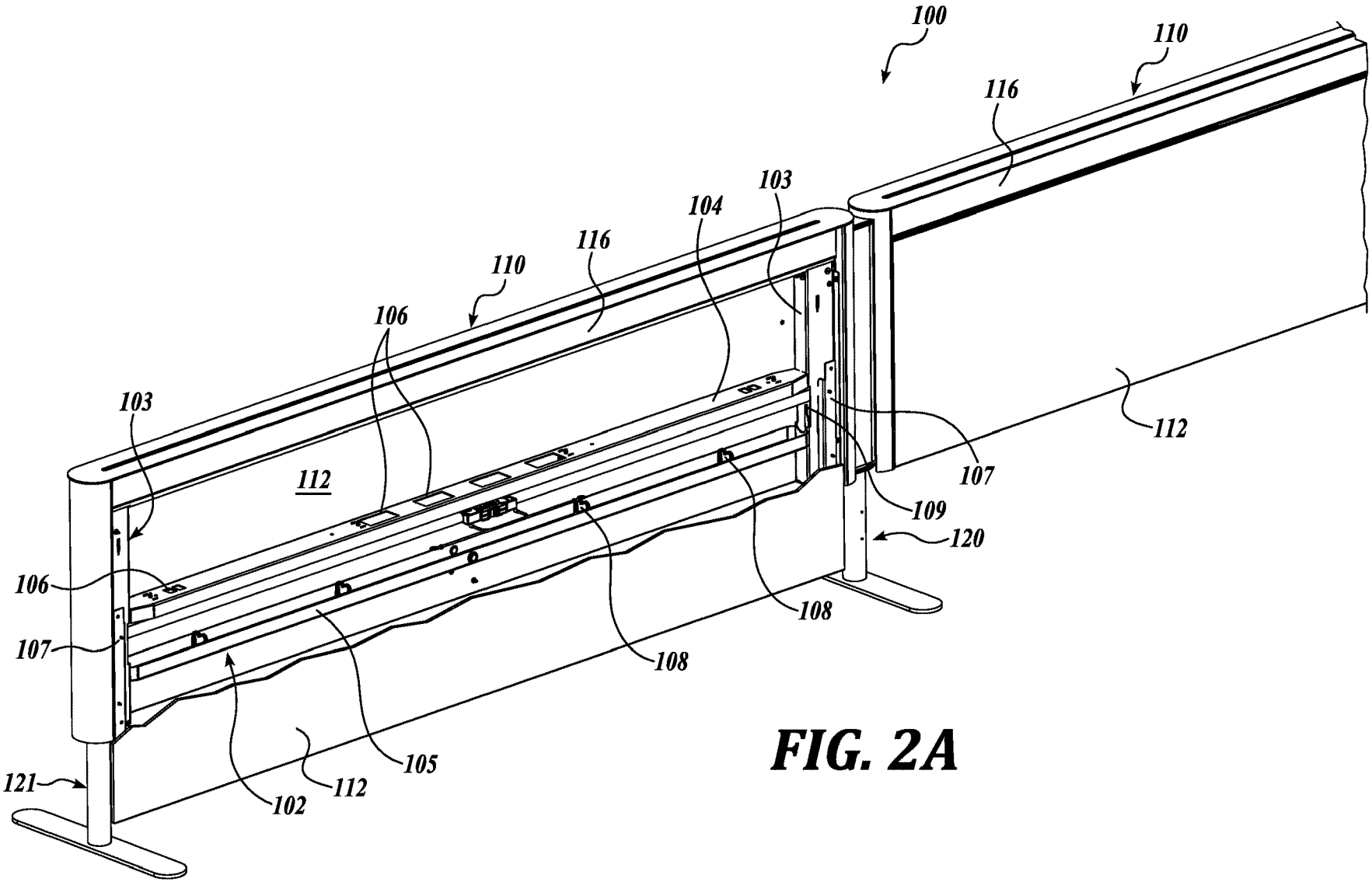
FIG. 2A is a fragmentary, partially cut-away view of the partition system shown in FIG. 1A.
Figure 2B:
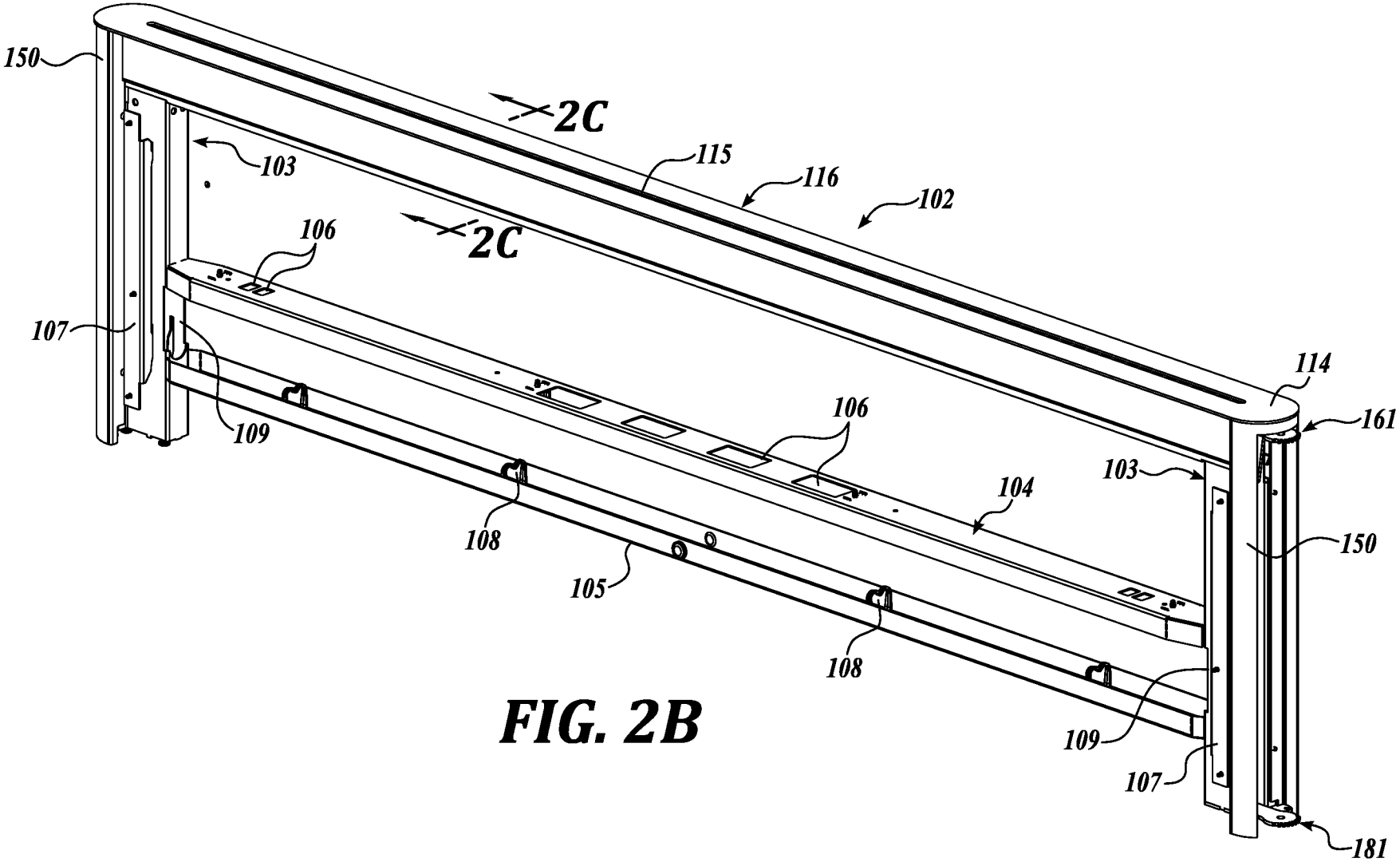
FIG. 2B is a perspective view of a frame for the partition shown in FIG. 1A shown in isolation.

Refer now also to FIG. 2A showing the partition system 100 in which one of the panels 112 is moved to a shifted to a lower position (illustrated in cut-away) providing access to an interior of the associated partition 110 and exposing a portion of a frame assembly 102 of the partition 110. Refer also to FIG. 2B which shows the frame assembly 102 in isolation. One or both panels 112 of the partitions 110 are configured to be movable between the upper position and the lower position.

The frame assembly 102 includes (or extends downwardly from) the mounting subassembly 116. Left and right upright members 103 are attached to the mounting subassembly 116. A first cross member 104 extends between and connects the upright members 103 at an intermediate location below the mounting subassembly 116, and a second cross member 105 connects the upright members 103 at a location below the first cross member 104. The first cross member 104 includes one or more power and/or data ports 106 (illustrated diagrammatically). The ports 106 are user-accessible when a panel 112 is moved to the lower position. The second cross member 105 preferably has a generally U-shaped cross section upwardly open along at least a portion of its length, defining a channel to support power and or data cables (not shown) for the power and/or data ports 106. The first cross member 104 and the second cross member 105 may further include cable/conduit retainers 108 to removably retain the cables. The upright members 103 include an aperture 109, preferably located vertically between the first and second cross members 104, 105 defining a path for cables to extend from one partition 110 to an adjacent partition 110.

Slidable hanger members 107 are configured to support the panels 112. In a current embodiment the hanger members 107 are upwardly biased such that the panels 112 return to the upper position when not in use. The panels 112 may be hung or otherwise releasably attached to the hangar members 107, for easy removal and replacement, for example, to facilitate installation and maintenance of the data and/or power cables and ports 106.

Figure 2C:
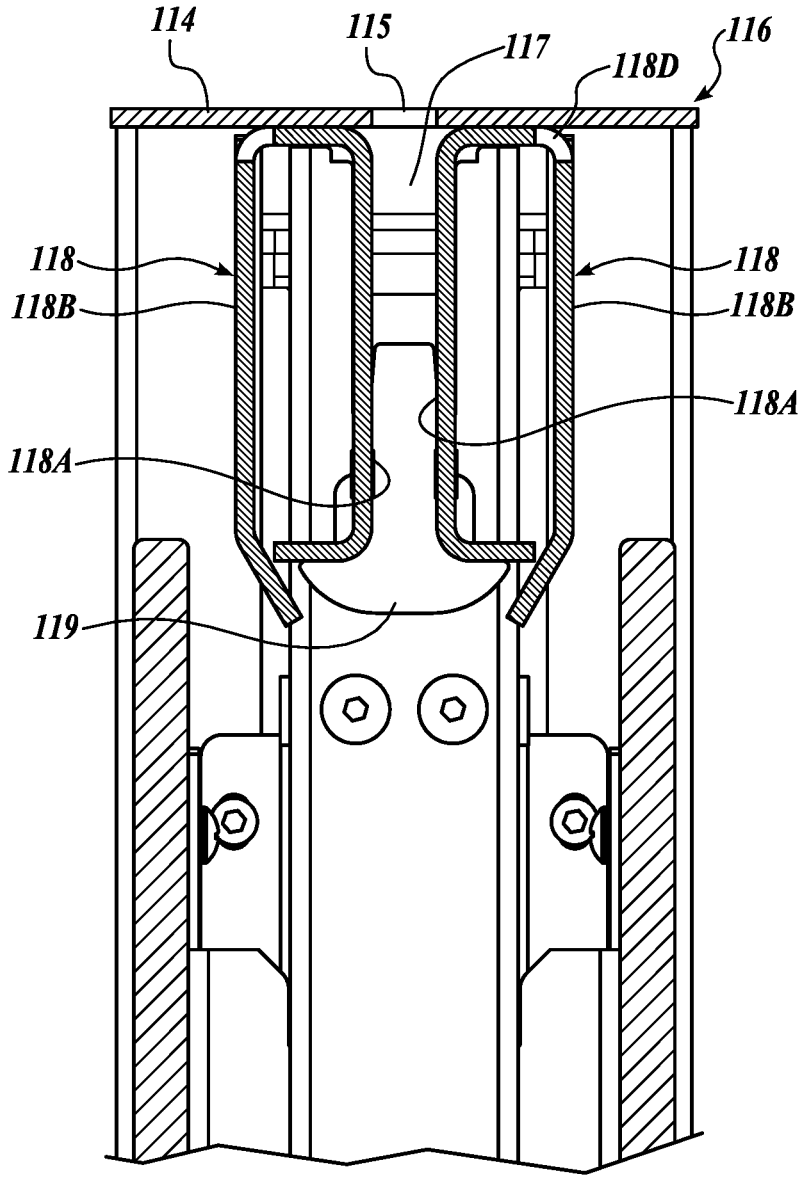
FIG. 2C is a fragmentary sectional view of the frame through section 2C-2C indicated in FIG. 2B.
Figure 2D:
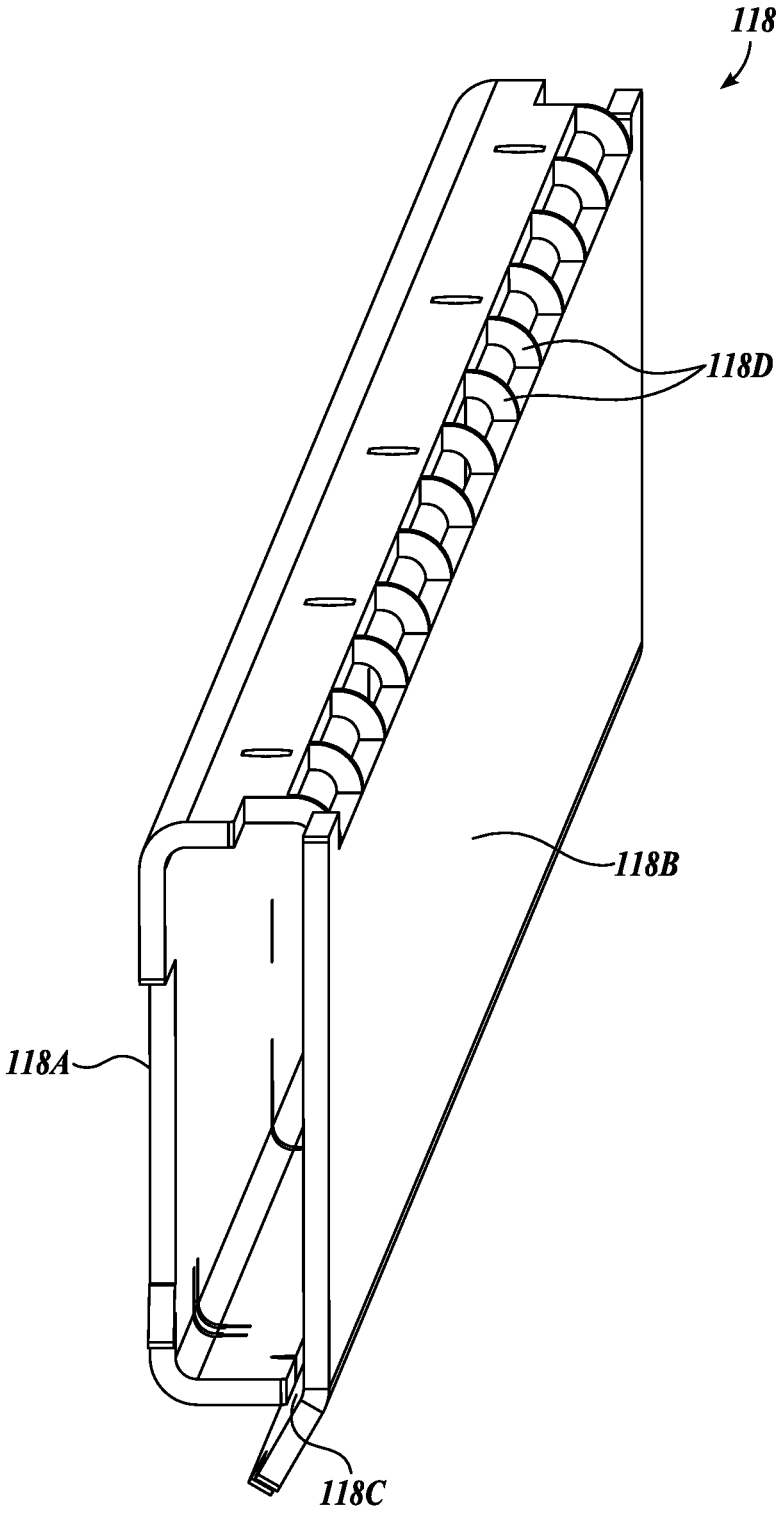
FIG. 2D is a perspective view of one of two elongate frame members of the frame shown in FIG. 2B.

Refer now also to FIG. 2C, showing a section view of the frame assembly 102 through section 2C-2C indicated in FIG. 2B, and showing details of the accessory mounting subassembly 116. The mounting subassembly 116 includes an upper plate 114 defining one or more slots 115. A pair of spaced-apart elongate frame members 118 are positioned below the upper plate 114 and positioned on opposite sides of the slot 115. In this embodiment the elongate members extend along most or the length of the partition 110. In other embodiments the members may be formed from a plurality of short members or extend only along a shorter portion of the partition. A plurality of spacing members 119 (one visible) extend between and connect the elongate members 118. The spacing members 119 slidably engage an inner portion 118A of the elongate members 118. Refer also to FIG. 2D showing a perspective view of one of the elongate frame members 118. An inner portion 118A of the elongate members 118 define facing surfaces, that are generally planar and parallel, such that an elongate channel 117 is defined between the elongate members 118 below the slot 115. The channel 117 is configured to engage the connector portion 92 of the accessory 90 (FIG. 1A). Optionally, an outer portion 118B of the elongate member 118 may be connected to the inner portion 118A by a spring portion 118D that may be formed, for example, by a plurality of apertures or recesses along an upper edge of the elongate member 118. A gap 118C is defined along a lower end of the elongate member 118 that allows the inner portion 118A to elastically flex towards the outer portion 118B to elastically retain the accessory connector portions 92.

Figure 3A:
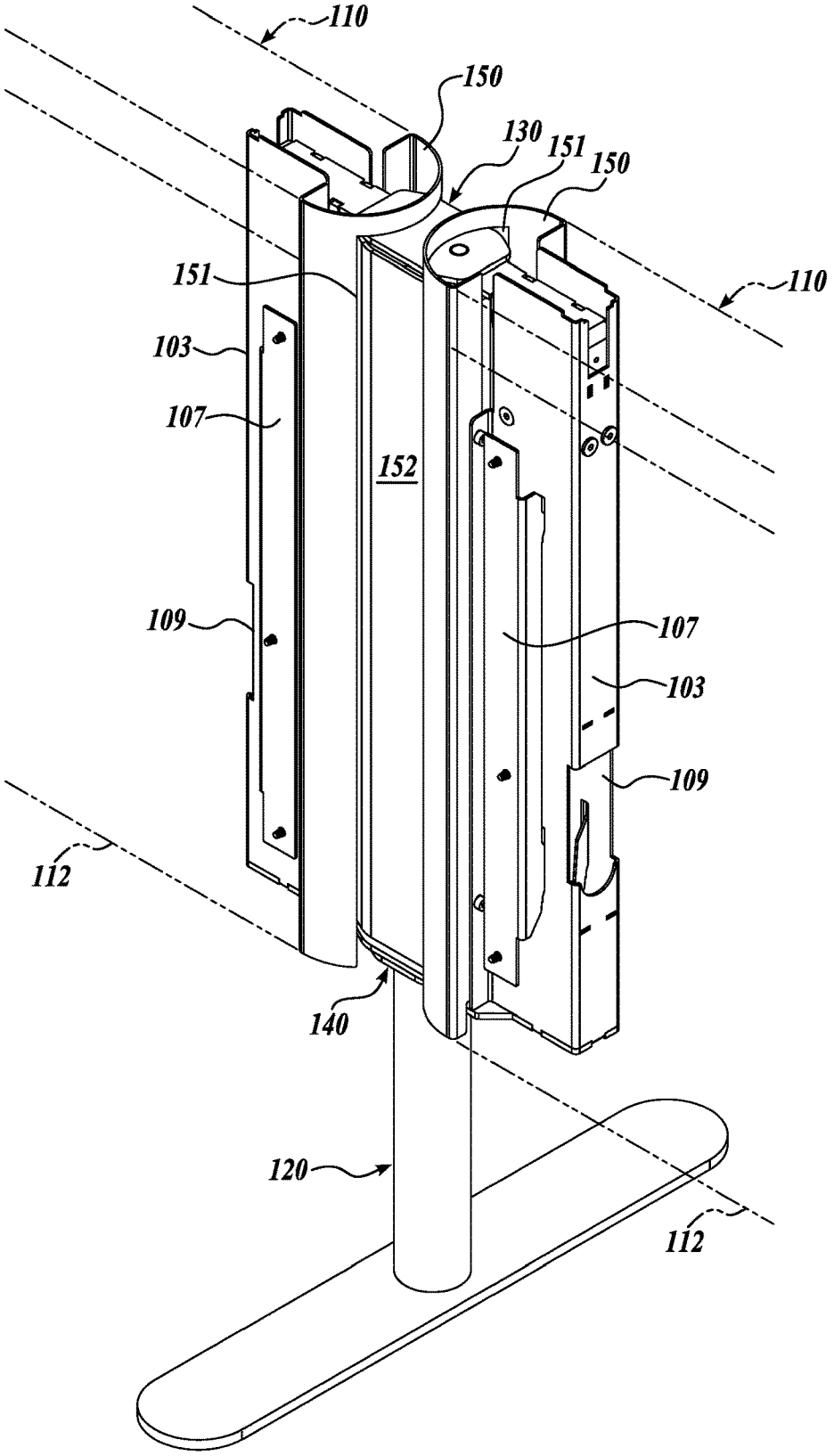
FIG. 3A shows a joint assembly between two partitions of the workspace partition system shown in FIG. 1A.
Figure 3B:
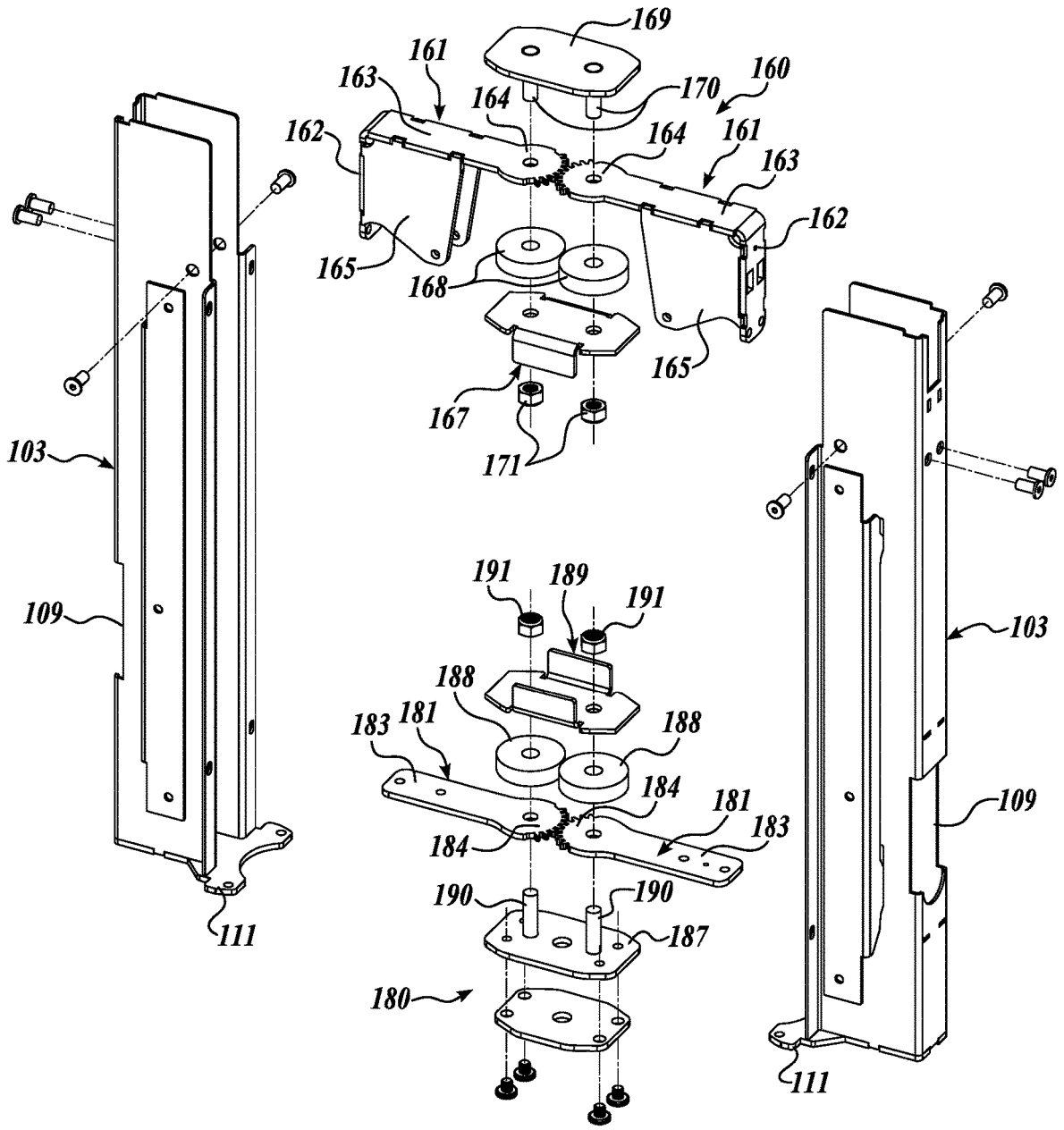
FIG. 3B is an exploded perspective view of the joint assembly shown in FIG. 3A.

FIG. 3A is a perspective view of a portion of the partition system 100 shown in FIG. 1A that includes an interior leg assembly 120 with an upright member 103 of the frames 102 of two adjacent partitions 110 (with panels 112 and the accessory mounting subassembly not shown). Each of the partitions 110 include a generally U-shaped curved end panel 150 that extends vertically along the edge of the associated partition 110, wherein the panel 150 has an opening 151 extending substantially along a length of the end panel 150. The end panels 150 may be positioned for installation by sliding the end panel 150 vertically down to the position shown. A pair of end panels 152 (one visible), located on opposite sides of the panels 110, extend between the end panels 150 of the adjacent partitions 110 and through the corresponding openings 151. FIG. 3B shows a partially exploded view of the subassembly shown in FIG. 3A (with end panels 150, end panels 152, and leg assembly 120 removed for clarity), wherein the upright members 103 are moved outwardly, exposing an upper hinge assembly 160 configured to connect upper ends of the upright members 103 and a lower hinge assembly 180 connecting a lower end of the upright members 103.

The upper hinge assembly 160 comprises a pair of L-shaped gear arms 161 with a vertical portion 162, and a horizontal portion 163. Front and back side plates 165 (front side plates visible) connect the vertical portion 162 with the horizontal portion 163, thereby defining a sturdy corner box structure. The gear arm vertical portions 162 and the side plates 165 attach the angled gear arms 161 to the associated one of the upright members 103, for example, with bolts or other fastening hardware. The distal ends of the horizontal portions 163 define gear head portions 164 that are engaged in the assembled joint (see FIGS. 4A and 4B). Spacing support members 168 abut the gear head portions 164. The support members 168 facilitate smooth pivoting of the hinge assembly 160 and aid in maintaining the gear head portions 164 in the desired engaged alignment. A connecting assembly includes an upper plate member 169, a lower plate member 167, and connecting members 170, 171. The connecting assembly holds the upper hinge assemblies 160 together and maintains the gear head potions 164 pivotably engaged. For example, the connecting members 170, 171 in this embodiment comprise threaded posts 170 and nuts 171.

The lower hinge assembly 180 includes a pair of gear members 181 that each include a plate portion 183 that extends into and is attached to a mounting plate 111 fixed to a corresponding one of the frame upright members 103, and a gear head portion 184. Spacer members 188 abut the gear head portions 184. A similar connecting assembly includes an upper plate member 188, a lower plate member 187, and connecting members 190, 191, for example, threaded connecting members.

Referring still to FIGS. 3A and 3B a substantially open volume is defined between the upper hinge assembly 160 and the lower hinge assembly 180. The apertures 109 in the upright members 103 provide ports to this open volume allowing cabling (not shown) to readily pass through and between panel assemblies 110. The upper hinge assembly 160 and the lower hinge assembly 180 define two spaced-apart pivot axes that are constrained to pivot in a coordinated manner by the geared assemblies 160, 180 (see FIGS. 4A and 4B). Therefore cables (not shown) extending between partitions 110 are inherently protected from sharp bending angles when the partitions 110 are hingedly repositioned.

Figure 4A:
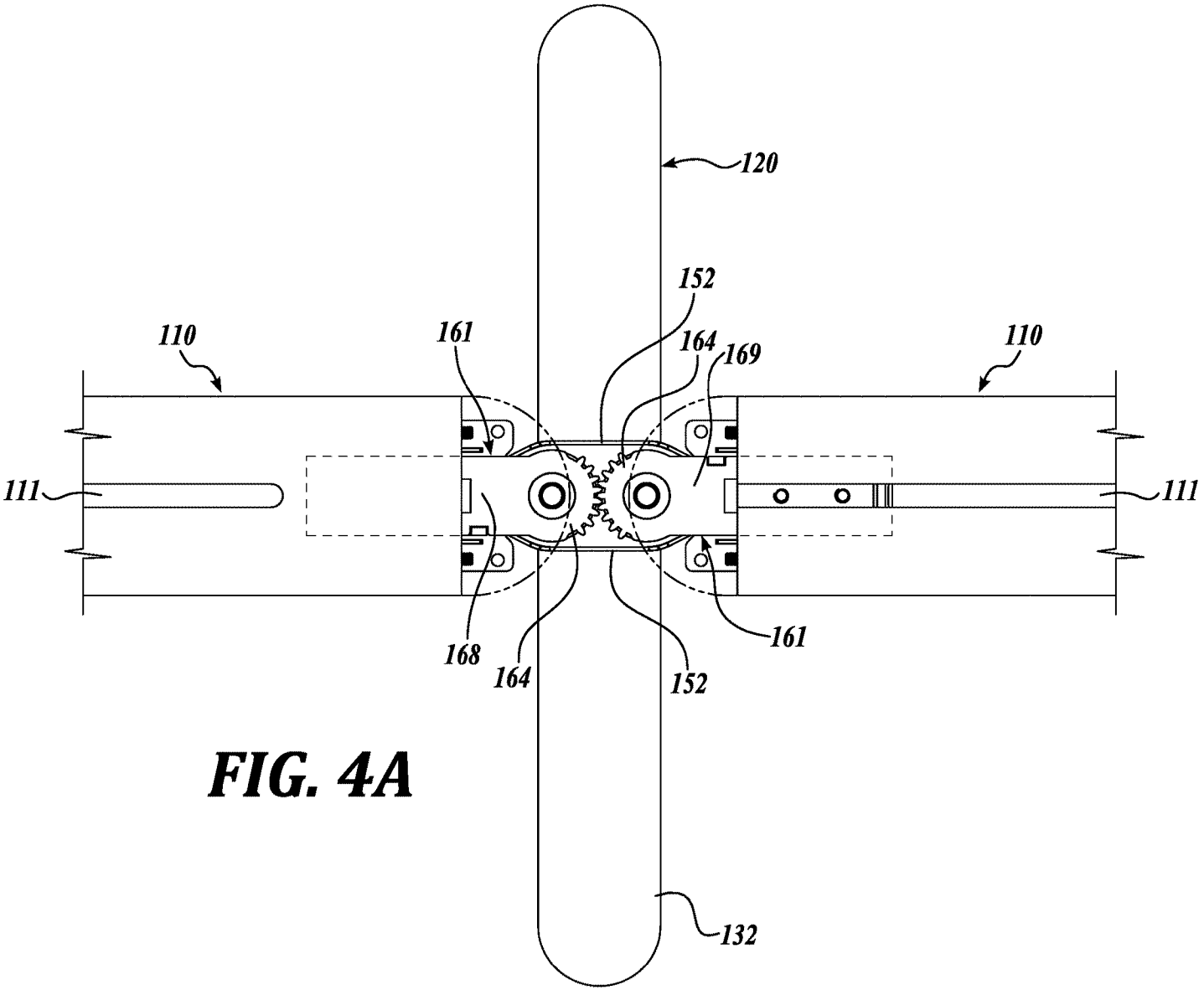
FIG. 4A is a plan view of the joint assembly shown in FIG. 3A, with the end panels and upper member omitted, showing the joint assembly in an aligned position.
Figure 4B:
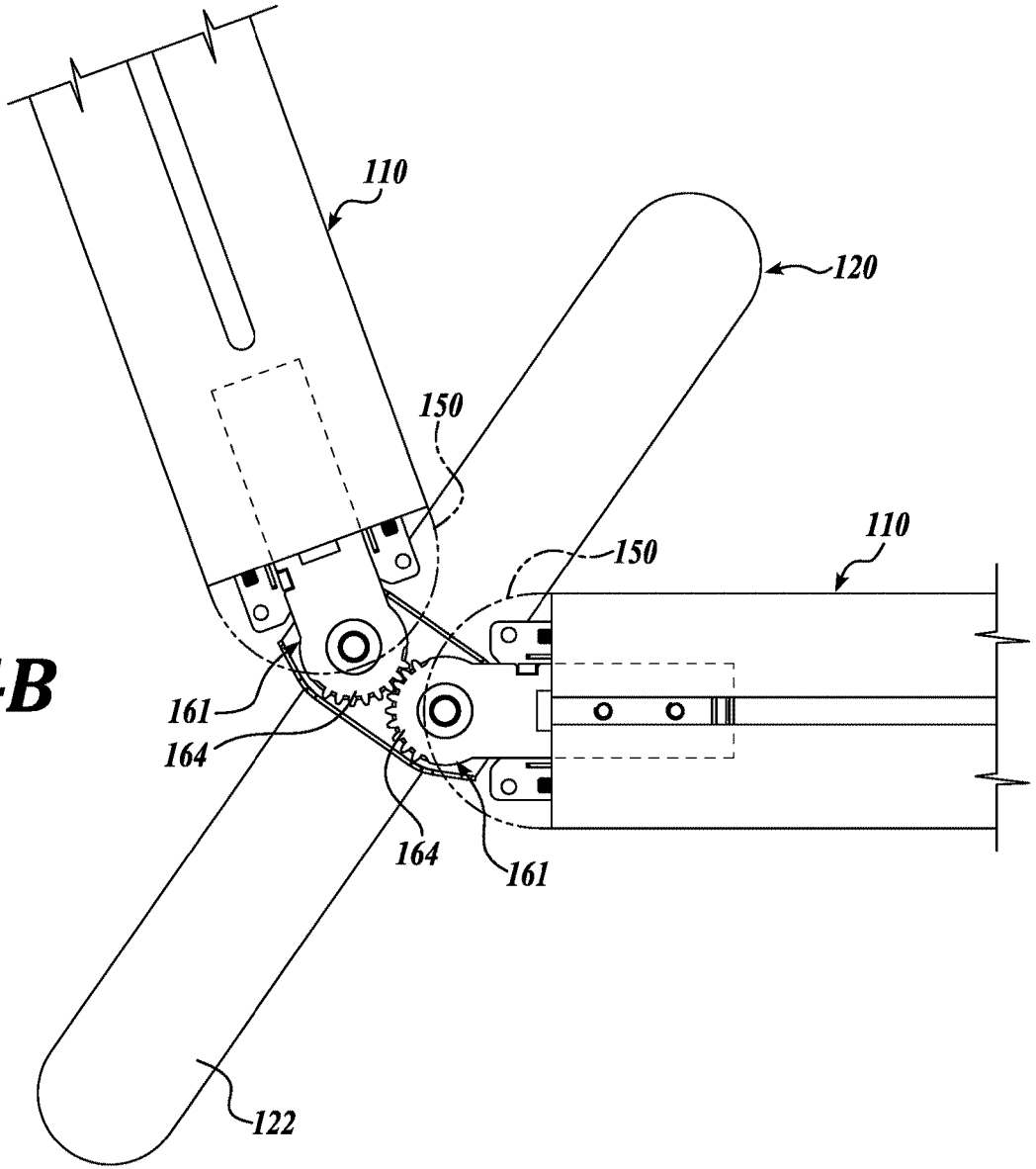
FIG. 4B is a plan view of the joint assembly shown in FIG. 3A, with the end panels and upper member omitted, showing the joint assembly in an angled position.

FIG. 4A is a top plan view of the geared joint between partitions 110, with the end panels 152 and the upper plate member 169 not shown, to show the gear arms 161 engaged, and with the partitions 110 aligned with each other. FIG. 4B is a top plan view of the geared joint showing the partitions 110 in a non-aligned configuration, i.e., disposed at an angle with respect to each other. The pivotable foot portion 122 is also positioned to provide optimal support to the partitions 110. The geared assemblies 160, 180 limit the flexure, or angles, that cabling extending between the panel assemblies 110 will encounter when the partitions 110 are repositioned, reducing the potential strain on cabling, and facilitating repositioning of the panel assemblies 110.

While illustrative embodiments have been illustrated and described, it will be appreciated that various changes can be made therein without departing from the spirit and scope of the invention.

The embodiments of the invention in which an exclusive property or privilege is claimed are defined as follows:

1. A partition assembly having a first end and a second end, the partition assembly comprising:

a plurality of partitions including a first partition hingedly connected to a second partition, the first partition and the second partition each comprising: i) a frame comprising a first upright member, a second upright member, a mounting assembly connecting the first and second upright members, and an upper cross member and a lower cross member each connecting the first and second upright member below the mounting assembly, ii) a first panel attached to one side of the frame, and iii) a second panel attached to an opposite side of the frame, wherein at least one of the first and second panels is configured to be movable between an upper position and a lower position providing access to the first and second crossmembers;

an upper hinge assembly extending between and connecting the first partition to the second partition, the upper hinge assembly comprising a first gear arm fixed to the first partition and having a gear head extending away from the first partition, a second gear arm fixed to the second partition and having a gear head extending away from the second partition and engaging the gear head of the first gear arm, and a connection assembly pivotably holding the first gear head and the second gear head in the engaged position; and a lower hinge assembly extending between and connecting the first partition to the second partition, the lower hinge assembly comprising a third gear arm fixed to the first partition and having a gear head extending away from the first partition, a fourth gear arm fixed to the second partition and having a gear head extending away from the second partition and engaging the gear head of the third gear arm, and a connection assembly pivotably holding the third gear head and the fourth gear head in the engaged position;

wherein the first upright member of the first partition includes a first aperture and the second upright member of the second partition includes a second aperture that is aligned with the first aperture, the first and second apertures providing a cable passageway from an interior of the first partition to an interior of the second partition between the upper hinge assembly and the lower hinge assembly; and wherein the mounting assembly further comprises an upper mounting plate having at least one slot aligned with the elongate frame members.

2. The partition assembly of claim 1, further comprising at least one end leg assembly that extend downwardly from the first end of the partition assembly and at least one interior leg assembly that extends downwardly from a position between the first and second partitions.

3. The partition assembly of claim 2, wherein the at least one end leg assembly and the at least one interior leg assembly are height adjustable.

4. The partition assembly of claim 2, wherein the at least one end leg assembly and the at least one interior leg assembly comprise a post and an elongate foot portion.

5. The partition assembly of claim 1, further comprising at least one power port fixed to the upper cross member.

6. The partition assembly of claim 5, further comprising at least one data port fixed to the upper cross member.

7. The partition assembly of claim 6, wherein the lower cross member has a U-shaped cross section and a plurality of cable keepers.

8. The partition assembly of claim 5, further comprising a power cable that extends through the cable passageway from the interior of the first partition into the interior of the second partition.

9. The partition assembly of claim 1, wherein the mounting assembly is configured to releasably attach accessories to the partition assembly.

10. The partition assembly of claim 9, wherein the mounting assembly comprises a pair of spaced-apart elongate frame members that extend along a length of the mounting assembly.

11. The partition assembly of claim 9 wherein the accessories include one or more of lights, privacy panels, and side tables.

12. A partition assembly having a first end and a second end, the partition assembly comprising:

a first partition hingedly connected to a second partition, wherein the first partition and the second partition each comprising: i) a frame comprising a first upright member, a second upright member, an upper cross member and a lower cross member, the upper and lower cross members each connecting the first upright member to the second upright member, ii) a first panel attached to one side of the frame, iii) a second panel attached to an opposite side of the frame, wherein at least one of the first and second panels is configured to be movable between an upper position and a lower position providing access to the first and second crossmembers, and iv) an accessory mounting assembly that is configured to selectively engage accessory components;

an upper hinge assembly extending between and connecting the first partition to the second partition, the upper hinge assembly comprising a first gear arm fixed to the first partition and having a gear head extending away from the first partition, a second gear arm fixed to the second partition and having a gear head extending away from the second partition and engaging the gear head of the first gear arm, and a connection assembly pivotably holding the first gear head and the second gear head in the engaged position; and a lower hinge assembly extending between and connecting the first partition to the second partition, the lower hinge assembly comprising a third gear arm fixed to the first partition and having a gear head extending away from the first partition, a fourth gear arm fixed to the second partition and having a gear head extending away from the second partition and engaging the gear head of the third gear arm, and a connection assembly pivotably holding the third gear head and the fourth gear head in the engaged position;

wherein the first upright member of the first partition includes a first aperture and the second upright member of the second partition includes a second aperture that is aligned with the first aperture, the first and second apertures providing a cable passageway from an interior of the first partition to an interior of the second partition between the upper hinge assembly and the lower hinge assembly; and wherein the mounting assembly further comprises an upper mounting plate having at least one slot aligned with the elongate frame members.

13. The partition assembly of claim 12, further comprising at least one end leg assembly that extend downwardly from the first end of the partition assembly and at least one interior leg assembly that extends downwardly from a position between the first and second partitions.

14. The partition assembly of claim 13, wherein the at least one end leg assembly and the at least one interior leg assembly are height adjustable.

15. The partition assembly of claim 13, wherein the at least one end leg assembly and the at least one interior leg assembly comprise a post and an elongate foot portion.

16. The partition assembly of claim 12, further comprising at least one power port fixed to the upper cross member.

17. The partition assembly of claim 16, further comprising at least one data port fixed to the upper cross member.

18. The partition assembly of claim 17, wherein the lower cross member has a U-shaped cross section and a plurality of cable keepers.

19. The partition assembly of claim 17, further comprising a power cable that extends through the cable passageway from the interior of the first partition into the interior of the second partition.

* * * * *